United States Patent [19]

Keppel

[11] Patent Number: 4,550,441

[45] Date of Patent: Oct. 29, 1985

[54] VENTED BAG

[75] Inventor: Stephen C. Keppel, Ridgefield, Conn.

[73] Assignee: St. Regis Paper Company, West Nyack, N.Y.

[21] Appl. No.: 632,404

[22] Filed: Jul. 18, 1984

[51] Int. Cl.[4] ..... B65D 33/01

[52] U.S. Cl. ..... 383/103

[58] Field of Search ..... 383/100, 101, 103, 45

[56] References Cited

U.S. PATENT DOCUMENTS

| | | | |
|---|---|---|---|
| 2,593,328 | 4/1952 | Meaker | 229/55 |
| 3,026,656 | 3/1962 | Rumsey, Jr. | 383/103 |
| 3,092,249 | 6/1963 | Chapman | 206/46 |
| 3,302,859 | 2/1967 | Perry | 229/53 |
| 3,370,780 | 2/1968 | Shaw | 229/62.5 |
| 3,394,871 | 7/1968 | Williams et al. | 229/62.5 |
| 3,439,869 | 4/1969 | Shrum et al. | 229/62 |
| 3,468,471 | 9/1969 | Linder | 229/62.5 |
| 3,958,749 | 5/1976 | Goodrich | 383/111 |
| 4,057,144 | 11/1977 | Schuster | 206/439 |
| 4,071,187 | 1/1978 | La Fleur | 383/45 |
| 4,470,153 | 9/1984 | Kenan | 383/103 |

FOREIGN PATENT DOCUMENTS

| | | | |
|---|---|---|---|
| 1536367 | 12/1969 | Fed. Rep. of Germany . | |
| 961222 | 6/1964 | United Kingdom | 383/45 |
| 1016476 | 1/1966 | United Kingdom . | |

*Primary Examiner*—Stephen P. Garbe

*Attorney, Agent, or Firm*—Kramer & Brufsky

[57] ABSTRACT

A multiwall commodity bag comprising a sealed plastic tube having a longitudinal seam formed by overlapping margins sealed together by two spaced seals to provide a channel. The overlapping margins are formed with openings only at the opposite ends of the channel, one of the openings being formed in one of the overlapping tube margins at one end of the channel and providing communication between the interior of the tube and the channel to permit escape of air through the tube, another of the openings being formed in the other overlapping tube margin at the opposite end of the channel and providing communication between the interior of the channel and the exterior of the tube. The size and number of openings are such as to permit venting of the tube while inhibiting flow of commodity into the channel or admission of external contaminants into the channel.

7 Claims, 4 Drawing Figures

VENTED BAG

TECHNICAL FIELD

This invention pertains to an improvement in a multiwall bag of the so called pinch bottom type and more particularly, a multiwall pinch bottom bag constructed to allow air to escape from a sealed pouch housed inside of the multiwall bag.

PRIOR ART

Bags of this type of construction contain a plurality of plies of flexible sheet material, such as paper, laminated to one another in superimposed relation which are formed into a tube having gusseted side-walls interposed between front and back walls, one of which overlaps the other at each bag end. One overlapping end in the bag is folded over and sealed against the opposite wall to provide an open ended bag ready for filling, usually with a bulk, granular or powdery material, whereupon the opposite overlapping end is similarly folded over and sealed against the opposite wall thereby to completely seal the packaged material within the bag enclosure. Also, in such bags as heretofore produced, the innermost ply was sometimes provided with a moisture impervious plastic coating or an innermost ply of plastic material which was permanently laminated to the innermost paper ply.

All such conventional bag constructions were objectionable for the packaging of comestibles, such as dry powdered milk, eggs or the like, in that during handling and shipment the bag exteriors become highly contaminated with dust, bacteria and other contaminating substances, to the extent that it becomes extremely difficult, if not impossible to prevent contamination of the packaged material when the bag is opened to discharge the contents.

In an effort to prevent such contamination, it has become common practice to manually insert into an open ended paper bag a separate plastic pouch, and then after the pouch within the bag is filled, the pouch itself is manually tied closed at its open end and pushed down into the bag so that it does not interfere with closure of the bag itself, usually accomplished by sewing the closure. This practice is objectionable in that it requires that the bag and pouch components be separately produced and the components manually assembled, which is unduly expensive. Also the manual tying of the pouch when filled and subsequent closure of the bag proper retards the closure operations. In addition, the manual handling of the plastic pouch in the bag and pouch assembly and tying operations, as well as the subsequent untying to discharge the contents, are sources of potential contamination.

Accordingly, in order to eliminate these highly objectionable features, it has been proposed to provide an innermost bag ply of a heat sealable plastic material, which is loosely adhered to a contiguous paper ply for manual detachment therefrom and which is heat sealed transversely of the bag at the closed end, the bag closure at said end being otherwise completed by folding over an overlapping wall portion of the outermost plies and sealing against the opposite wall. Also when the bag is filled with a comestible or the like, the opposite end of the plastic ply is closed by heat sealing prior to folding over and sealing the overlapping wall portions of the outermost plies at said end. The plastic ply is of such length as not to be included in the sealed bag end closures provided by the outermost plies. The bag may thus be opened in the outermost plies leaving intact the plastic ply and its contents. Since the plastic ply is only lightly adhered to the contiguous ply, the outer plies may be torn or cut away and peeled off of the plastic ply without rupture thereof for removal of a thus completely sealed and impervious plastic ply container of the packaged material. For removal of the packaged contents without contamination, the exterior of this plastic container may be sterilized and the container slit and its contents discharged under wholly sterile conditions in a sterile atmosphere. Examples of such multiwall bag constructions are completely illustrated and described in U.S. Pat. Nos. 3,807,626; 3,910,488; and 4,088,264; whose disclosures are all incorporated herein by reference.

One further problem that has been encountered with bags of this type is that air can be entrapped within the product, such as non-fat dry milk, in the pouch or air can be entrapped in the area of the pouch above the product at the time the plastic pouch is sealed. Upon stacking of the bags, any entrapped air in the pouch would be pushed against the interior sides of the pouch, rupturing the seal on the pouch and causing contamination of the pouch contents.

One solution to this problem is disclosed in U.S. Pat. No. 3,302,859, which relates to a bag having a longitudinal seam with overlapping margins secured together throughout their length, and where one of the margins has a series of vents therein to allow air to escape from the bag. The embodiments disclosed in this patent, however, have no means for preventing material in the bag from entering the space between the overlapping margins and, vice-versa, to prevent contaminants from entering the bag from its external environment, through the air vents.

Accordingly, to allow proper stackability and to prevent rupture of the pouch seal, as much air as practicable should be allowed to freely escape from the pouch and bag, without loss of the pouch contents and without exposure of the pouch contents to contamination. This invention provides such an improved means of deaeration.

In a previous invention disclosed in U.S. patent application Ser. No. 366,548, filed Mar. 8, 1982, now U.S. Pat. No. 4,470,153, dated Sept. 4, 1984 and assigned to the same assignee as the present invention, a method for deaerating a bag is disclosed where air is allowed to escape along a longitudinal seam formed during the production of the inner plastic pouch. A spacer of paper or filter-type material such as filter cord is positioned along the length of the pouch between overlapped portions of the plastic pouch forming the seam. Holes are punched or die cut in the seam area material on the inside of the seam, that is, on the side of the seam facing the product and two longitudinal beads of a thermoplastic-type of adhesive are used to join the pouch material to form the seam, the adhesive being positioned on opposite sides of the spacer. Air could then travel in the channel along the film overlap between the two beads of adhesive and either out another staggered set of holes provided in the the overlap in the area furthest away from the product, or alternatively, through a heat seal closure which is rendered non-continuous in that area because of the filter material or paper vent strip incorporated into the seam seal. The use of the additional spacer element between the plies of the longitudinal seam was deemed necessary to prevent the opposed portions of the channel from adhering to each other when the overlap was adhesively sealed using heat and pressure and to impede the flow of granular material from the interior through the vent holes and/or contaminants from entering from the exterior. While this arrangement generally proved satisfactory, it rendered the bag more difficult and expensive to manufacture.

SUMMARY OF THE INVENTION

Accordingly, it has been determined that the spacer element could be eliminated without the loss of its function by forming the longitudinal seam by overlapping the marginal areas of the plastic liner and adhesively securing spaced portions of the overlap using spaced longitudinal beads of a non-heat responsive type of adhesive along the overlapped areas to form the air channel. A thermoplastic adhesive responsive to heat and pressure can be used if care is taken not to adhere the entire marginal overlaps to itself. In lieu of a series of vent holes or openings along one or both of the overlapped margins of the channel, a small hole the size of a pinhole is formed through the inner side of the center of the overlap forming the channel near one end. A small hole is also formed through the outer side and near the center of the channel adjacent the other end of the plastic pouch. Sufficient air has been found to flow from the interior to the exterior of the inner pouch bag, which is sealed at opposed ends, through the channel without fear of any substantial amount of bulk material being entrained in the flow because of the use of a single small opening providing minimum exposure to the interior of the pouch.

BRIEF DESCRIPTION OF THE DRAWINGS

Further objects and advantages of the invention will become more apparent from the following description and claims and from the accompanying drawings, wherein:

DETAILED DESCRIPTION

Figure 1:
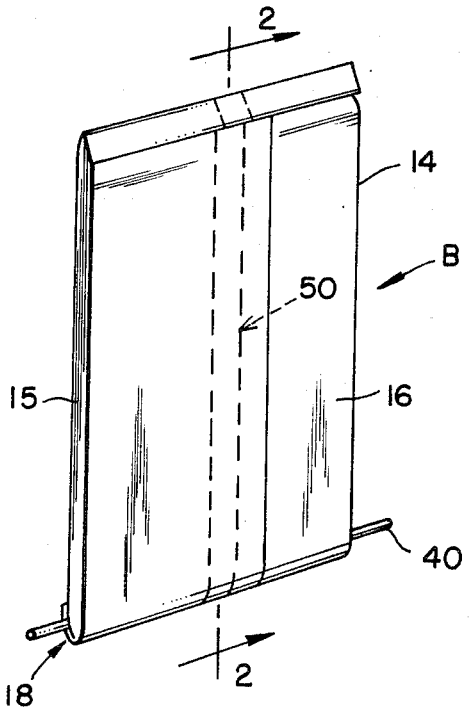
FIG. 1 is a perspective view of the bag of the present invention.

Referring now to the drawings in detail, wherein like numerals indicate like elements throughout the several views, the bag B shown therein consists essentially of front and rear walls 16 and 17, respectively, each of which includes an innermost ply 10 of a heat sealable thermoplastic material, and three outer plies 11–13, made preferably of heavy kraft paper, although other suitable flexible sheet stock may be employed. The bag is gusseted along oppositely disposed sidewalls, as at 14, 15, on opposite sides of relatively wide front and rear walls 16, 17.

The bag B as manufactured, is initially open at the top and closed at the bottom with a pinch bottom closure as at 18, described in detail hereinafter. The paper plies 11–13 of each wall are securely laminated to one another at the top and base of the bag, while the plastic ply 10 is only lightly adhered to the contiguous paper ply 11 at the top and base of the bag as at 19 and 20.

Figure 2:
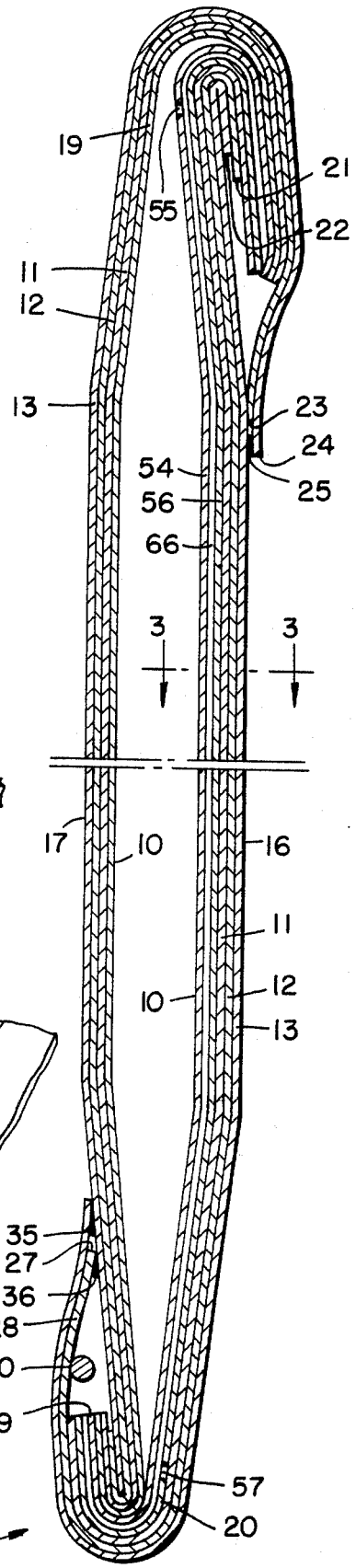
FIG. 2 is a longitudinal cross-sectional view of the bag of FIG. 1, taken substantially along the plane indicated by line 2—2 of FIG. 1.
Figure 3:
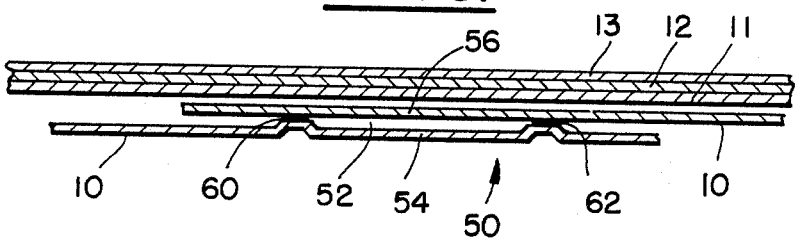
FIG. 3 is a cross-sectional view taken substantially along the plane indicated by line 3—3 of FIG. 2.
Figure 4:
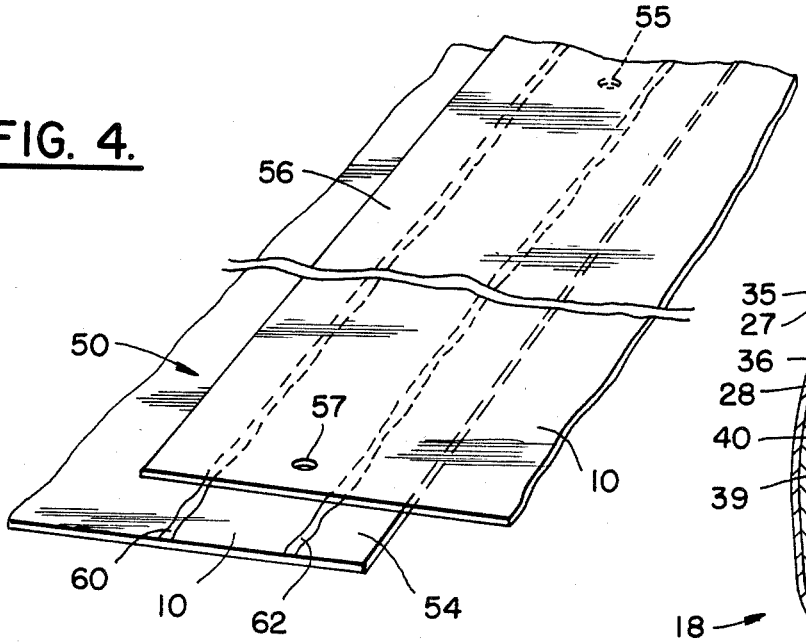
FIG. 4 is a partial perspective view, with portions broken away for purposes of illustration, of the seam area of the inner pouch bag contained within the bag of FIG. 1.

As best shown in FIG. 2, the plastic and contiguous paper plies 10, 11 respectively, are substantially flush cut in the front and rear walls and in the gussets, and the outer plies 12, 13, are substantially flush cut coincident therewith in the gussets. However, the outer plies 12, 13 are stepped successively upward in the front wall 16 with respect to plies 10, 11, as shown at 21, 22, and are stepped successively downward with respect thereto in the back wall 17, as at 23, 24. In the back wall, therefore, the outer plies 12, 13, extend beyond or overlap all plies in the gusset and front wall portions of the bag at the open top end, and thus may be folded over and sealed at spaced spots against the corresponding plies in the front wall or on the outermost ply 13 thereof, for which purpose the overlap area is coated with a thermoplastic adhesive, at spaced spots, as at 25, once the bag B is filled. This leaves the bag open to the atmosphere at spaced locations along the seal for the transmission of air from the interior of the bag B as will be made clear hereinafter.

At the bottom of the bag, the outer plies 12, 13 are correspondingly stepped with respect to the inner plies 10, 11 except in the reverse order as between the back and front walls. Closure at the base of the bag to provide the pinch bottom closure 18 is accomplished in two steps. The first step consists in applying heat and pressure between the opposite walls of the blank at the lower end, as by means of hot compression rolls or bars. This heat seals the oppositely disposed wall portions of the thermoplastic ply to each other to provide a sealed closure of the ply at the bottom of the bag. A thermoplastic adhesive is then applied to the stepped portions of plies 12, 13 as at 35, 36 and the overlapping portions 27, 28 of the outer plies 12, 13 are folded over against the opposite wall of the bag as shown in FIG. 2, and compressed between compression rolls or bars to complete the bottom closure of the bag. It will be noted with reference to FIG. 2, that in producing this closure, the outer bag plies 11, 12, 13 are looped about the lower sealed end of the thermoplastic ply 10, as at 39, so that if the bag is subsequently opened at the bottom by slitting only the outer plies 11, 12, 13 the thermoplastic ply will remain intact.

In order to assure opening the bag in this manner, a rip cord or tear string 40, is interposed as shown in FIG. 2, between ply 12 of front wall 16 and ply 13 of rear wall 17, upon folding over and completing the bag closure in the manner above described.

Air has a tendency to be entrapped within the product bulk packaged in the thermoplastic ply 10 or the bag pouch such as non-fat dry milk during filling of the ply, or air can be entrapped in the area of the ply above the product at the time the plastic ply is sealed. Upon stacking of the bags B, any entrapped air in the ply would be pushed against the interior sides thereof, possibly rupturing the seal on the ply and causing contamination of the ply contents or the air could cause the bags B, when stacked, to assume a higher elevation than normal, which is deleterious, where space constraints are important.

Air is allowed to escape along a longitudinal seam 50 formed during the production of the inner ply 10. The longitudinal seam 50 is formed by overlapping the marginal areas of the inner ply 10 and adhesively securing spaced portions of the overlap using spaced longitudinal beads of adhesive 60, 62 along the overlapped areas to form an air channel 52. A single small hole 55 is formed through the inner side 54 in the center of the overlap forming the channel 52 near one end. A single small hole 57 is also formed through the outer side 56 near the center of the channel 52 adjacent the other end of the plastic pouch. Air is thus permitted to flow from the interior to the exterior of the inner pouch bag 10, which is sealed at opposed ends, through the channel 52 without fear of any substantial amount of material being entrained in the flow because of the use of openings 55, 57 providing minimum exposure to the interior of the pouch. The air vented from channel 52 is discharged to the atmosphere by way of the spaces between spots 25, 35, 36 of adhesive connecting ply 13 of front wall 16 to ply 12 and/or 13 of rear wall 17.

The use of holes 55, 57, which are the size of a pinhole, substantially precludes material in the ply 10 from entering the seam channel 52 and vice-versa, from contaminants entering the ply 10 through the openings. For example, sample bags using a pouch bag with pinhole size vents 55, 57 were filled with powdered milk. In five hours, there was enough evacuation of air from the interior of pouch bag 10 to permit stable stacking. In twenty hours, there was complete evacuation and substantially no migration of the powdered milk into the channel 52.

While one small hole at each end of the channel should be sufficient in most cases to provide proper venting and inhibit flow of bulk material into the channel and admission of external contaminants into the channel, some applications may require a few small holes at each end of the channel. In any event, the size and number of holes at each end of the channel should be sufficient for venting of the inner pouch bag but insufficient to promote flow of bulk material into the channel or admission of external contaminants into the channel.

While in the preferred embodiment of the invention described above the vent channel 52 is applied to a plastic pouch inside of a multi-wall paper bag, it will be understood that the invention has application to a plastic pouch standing alone.

I claim:

1. A commodity bag comprising a sealed plastic tube having a longitudinal seam formed by overlapping tube margins sealed by two spaced seals and forming an unobstructed channel between the margins, the overlapping margins being formed with openings only at opposite ends of the channel, one of the openings being formed in one of the overlapping tube margins at one end of the channel and providing communication between the interior of the tube and the channel to permit escape of air from the tube, another of the openings being formed in the other overlapping tube margin at the opposite end of the channel and providing communication between the interior of the channel and the exterior of the tube, the size and number of openings being such as to permit venting of the tube while inhibiting flow of commodity into the channel or admission of external contaminants into the channel.

2. A bag in accordance with claim 1 wherein the openings are the size of pinholes.

3. A bag in accordance with claim 1 wherein there is only one opening in each of the margins.

4. A multiwall commodity bag comprising an outer tube of paper and an inner tube formed by a ply of plastic material sealed to closure at its opposite ends, and deaeration means for allowing trapped air within the inner tube to escape therefrom to relieve pressure on the inner tube, the deaeration means including a longitudinal seam formed by overlapping spaced side margins of the plastic ply joined along spaced lines and forming an unobstructed channel between the margins, the overlapping side margins being formed with openings only at opposite ends of the channel, one of the openings being formed in one of the overlapping side margins at one end of the channel and providing communication between the interior of the tube and the channel to permit escape of air from the tube, another of the openings being formed in the other overlapping side margin and providing communication between the interior of the channel and the exterior of the tube, the size and number of openings being such as to permit venting of the tube while inhibiting flow of commodity into the channel or admission of external contaminants into the channel.

5. A bag in accordance with claim 4 wherein the bag has front and back walls, the back wall of the outer tube having one of its ends formed with a closure flap overlapping and discontinuously secured to the front wall of the outer tube to provide openings intermediate the flap and the front wall communicating with the opening in said other overlapping side margin.

6. A bag in accordance with claim 4 wherein the openings are the size of pinholes.

7. A bag in accordance with claim 4 wherein there is only one opening in each of the margins.

* * * * *